US008074794B2

(12) United States Patent
Nakatsuka et al.

(10) Patent No.: US 8,074,794 B2
(45) Date of Patent: Dec. 13, 2011

(54) CHEMICALS MIXING CONTAINER WITH OFFSET COMMUNICATING HOLES

(75) Inventors: Toshiyuki Nakatsuka, Kyoto (JP); Yusei Kadobayashi, Kyoto (JP); Satoshi Takano, Kyoto (JP)

(73) Assignee: Kabushiki Kaisha Shofu, Kyoto (JP)

( * ) Notice: Subject to any disclaimer, the term of this patent is extended or adjusted under 35 U.S.C. 154(b) by 11 days.

(21) Appl. No.: 12/673,615

(22) PCT Filed: Aug. 16, 2007

(86) PCT No.: PCT/JP2007/065961

§ 371 (c)(1),
(2), (4) Date: Feb. 16, 2010

(87) PCT Pub. No.: WO2009/022425

PCT Pub. Date: Feb. 19, 2009

(65) Prior Publication Data

US 2011/0005945 A1 Jan. 13, 2011

(51) Int. Cl.
*B65D 25/08* (2006.01)

(52) U.S. Cl. ..... 206/222; 206/219

(58) Field of Classification Search ..... 206/219, 206/222, 63.5; 215/DIG. 8; 222/80, 82; 433/90

See application file for complete search history.

(56) References Cited

U.S. PATENT DOCUMENTS 4,941,751 A * 7/1990 Muhlbauer ..... 366/182.1
5,026,283 A * 6/1991 Osanai et al. ..... 433/90
RE33,801 E * 1/1992 Green ..... 222/82
5,172,807 A * 12/1992 Dragan et al. ..... 206/219
5,599,312 A 2/1997 Higashikawa (Continued)

FOREIGN PATENT DOCUMENTS

EP 0695555 2/1996

(Continued)

OTHER PUBLICATIONS

Patent Cooperation Treaty (PCT) International Preliminary Report on Patentability issued Mar. 9, 2010 in corresponding to International Application No. PCT/JP2007/065961.

(Continued)

*Primary Examiner* — David Fidei
(74) *Attorney, Agent, or Firm* — Wenderoth, Lind & Ponack, LLP

(57) ABSTRACT

A chemicals mixing container (1), which allows two kinds of chemicals, a liquid material (2) and a powder material (4), to be stored therein in isolation from each other and which allows the liquid material (2) and the powder material (4) to be mixed together. The mixing container includes: a first cylinder (6); a first piston (7) which is fitted in the first cylinder (6) to define a first internal space (3); a second cylinder (8) which is connected to the first cylinder (6) or the first piston (7) so as to be rotationally slidable thereon; and a second piston (9) which is fitted in the second cylinder to define a second internal space (5). The second cylinder (8) and the first cylinder (6) or the first piston (7) to which the second cylinder (8) is connected have communicating holes (13, 14) formed in their mutual sliding surfaces at positions, respectively, eccentric relative to a rotation axis X. The first internal space (3) and the second internal space (5) are communicated with or isolated from each other depending on a rotational sliding angle between the second cylinder (8) and the first cylinder (6) or the first piston (7) to which the second cylinder (8) is connected.

15 Claims, 6 Drawing Sheets

U.S. PATENT DOCUMENTS

| | | | | |
|---|---|---|---|---|
| 6,375,460 | B1 * | 4/2002 | Plaumann | 433/80 |
| 6,386,872 | B1 * | 5/2002 | Mukasa et al. | 433/90 |
| 6,682,347 | B2 * | 1/2004 | Aoyagi et al. | 433/90 |
| 6,869,284 | B2 * | 3/2005 | Aoyagi et al. | 433/90 |
| 7,311,195 | B2 * | 12/2007 | Schmid | 206/219 |
| 2001/0053511 | A1 * | 12/2001 | Aoyagi et al. | 433/90 |

FOREIGN PATENT DOCUMENTS

| | | |
|---|---|---|
| JP | 4-329954 | 11/1992 |
| JP | 8-206197 | 8/1996 |
| JP | 2002-523132 | 7/2002 |
| JP | 2003-522555 | 7/2003 |
| JP | 2004-41377 | 2/2004 |
| JP | 2004-41568 | 2/2004 |
| JP | 2007-61633 | 3/2007 |
| WO | 94/12227 | 6/1994 |
| WO | 00/10479 | 3/2000 |
| WO | 00/23002 | 4/2000 |

OTHER PUBLICATIONS

International Search Report issued Oct. 16, 2007 in International (PCT) Application No. PCT/JP2007/065961.

* cited by examiner

CHEMICALS MIXING CONTAINER WITH OFFSET COMMUNICATING HOLES

BACKGROUND OF THE INVENTION

1. Technical Field

The present invention relates to a chemicals mixing container which contains two kinds of chemicals in isolation from each other and which, at a time of use, allows those chemicals to be mixed together inside the container before being discharged. For example, the invention relates to a chemicals mixing container such as a dental cement capsule which contains a powder material and a liquid material as the two kinds of chemicals in isolation from each other and which allows the powder material and the liquid material to be mixed together before being discharged.

2. Description of the Related Art

For chemicals mixing containers such as dental cement capsules, it is desired that with two kinds of chemicals (powder material and liquid material) stored in isolation from each other, the chemicals mixing container is enabled to, at the time of use, mix together the powder material and the liquid material inside the chemicals mixing container and to discharge the resulting mixture from the chemicals mixing container with the least possible residues of the mixture.

With the conventional chemicals mixing container, it is often the case that mixing of two kinds of chemicals is enabled by, for example, screwing a protrusion into a partition wall of the internal space for containing the two kinds of chemicals to break through the partition wall.

JP 2007-61633 A describes a chemicals mixing container which includes: a first cylinder; a second cylinder for sealing the first cylinder to contain a first chemical and for, upon supply of a second chemical, forming a mixing chamber to mix together the first chemical and the second chemical and serving a role as a piston; and a piston for sealing the second cylinder to contain the second chemical and define an auxiliary chamber. A side wall of the second cylinder has an opening for making the auxiliary chamber and an external space of the second cylinder communicate with each other. In an inner wall of the first cylinder is formed a groove which can be made to communicate with the opening of the second cylinder by pushing in the second cylinder, and which extends in an axial direction of the cylinder while one end of the groove reaches the mixing chamber.

With this chemicals mixing container, different chemicals are contained in the mixing chamber and the auxiliary chamber, respectively. The chemicals are held in an isolated manner. In use of the chemicals mixing container, the second cylinder is pushed into the first cylinder along with the piston, so that the opening of the second cylinder communicates with the groove of the inner wall of the first cylinder, placing the auxiliary chamber and the mixing chamber in communication with each other via the groove of the first cylinder. Then, pushing in the piston allows the chemical material within the auxiliary chamber to be fed into the mixing chamber. After the two kinds of chemicals are well mixed in the mixing chamber, the piston is further pushed in so that the second cylinder is pushed deep in the first cylinder. Then, the mixture of the two kinds of chemicals can be extruded out through a nozzle provided at an end of the first cylinder.

SUMMARY OF THE INVENTION

Problems to be Solved by the Invention

An object of the present invention is to provide a chemicals mixing container in which two kinds of chemicals are stored in isolation from each other and which allows the two kinds of chemicals to be mixed together reliably.

Means for Solving the Problems

In order to achieve the above object, the present invention provides a chemicals mixing container comprising: a first cylinder; a first piston which is fitted in the first cylinder to define a first internal space; a second cylinder which is connected to the first cylinder or the first piston so as to be rotationally slidable thereon; and a second piston which is fitted in the second cylinder to define a second internal space. The second cylinder and the first cylinder or the first piston to which the second cylinder is connected have communicating holes formed in their mutual sliding surfaces at positions, respectively, eccentric to a rotation axis. The first internal space and the second internal space are communicated with or isolated from each other depending on a rotational sliding angle between the second cylinder and the first cylinder or the first piston to which the second cylinder is connected.

According to this configuration, depending on the rotational sliding angle between the second cylinder and the first cylinder or the first piston, the first internal space and second internal space in which different chemicals are contained can store those chemicals in isolation from each other, and in use of the chemicals mixing container, the first internal space and the second internal space can reliably be communicated with each other so that the two kinds of chemicals can be mixed together. The communicating holes may be provided in plural pairs.

In the chemicals mixing container of the invention, the first cylinder and the second cylinder may be formed into generally cylindrical and concentric shape.

According to this configuration, sliding surfaces of the second cylinder and the first cylinder or the first piston to which the second cylinder is connected can be enlarged. Therefore, the communicating holes can be enlarged to facilitate movement of the chemicals, and a separation distance for separation of the communicating holes can be extended to ensure the isolation of the chemicals.

Also, the chemicals mixing container of the invention may further comprise a rotation restricting structure for restricting a relative rotational range of the second cylinder and the first cylinder or the first piston to which the second cylinder is connected so that their respective communicating holes are communicated with each other at an end of the rotational range.

According to this configuration, communication or separation of the communicating holes is ensured, by which the isolation of different chemicals from each other in the storage state as well as the mixing of these chemicals in the use state are ensured.

Also in the chemicals mixing container of the invention, it may be that the first cylinder is formed into a cylindrical shape having an end wall, the first piston is formed into a cylindrical shape having an end wall which defines the first internal space in the first cylinder, the second cylinder is formed into a cylindrical shape having an end wall which is fitted inside the first piston and which slides in contact with the end wall of the first piston, and the communicating holes are formed in the end wall of the first piston and the end wall of the second cylinder, respectively.

According to this configuration, first, pushing in the second piston causes the second internal space to be compressed so that the chemical material is extruded, and further pushing in the second piston causes the first piston to be pushed in so that the mixture of chemicals can be discharged from the first internal space. In this way, mixing and discharge of the chemicals can be fulfilled, whichever is first in procedural order, only by operation of the second piston.

Effects of the Invention

According to the present invention, the second cylinder is connected to the first cylinder or the first piston so as to be rotationally slidable thereon, and communicating holes eccentric to the rotation axis are formed in their sliding surfaces. As a result, isolation of the first internal space and the second internal space from each other as well as their communication with each other can be ensured depending on the rotational sliding angle.

DESCRIPTION OF REFERENCE NUMERALS

Figure 1:
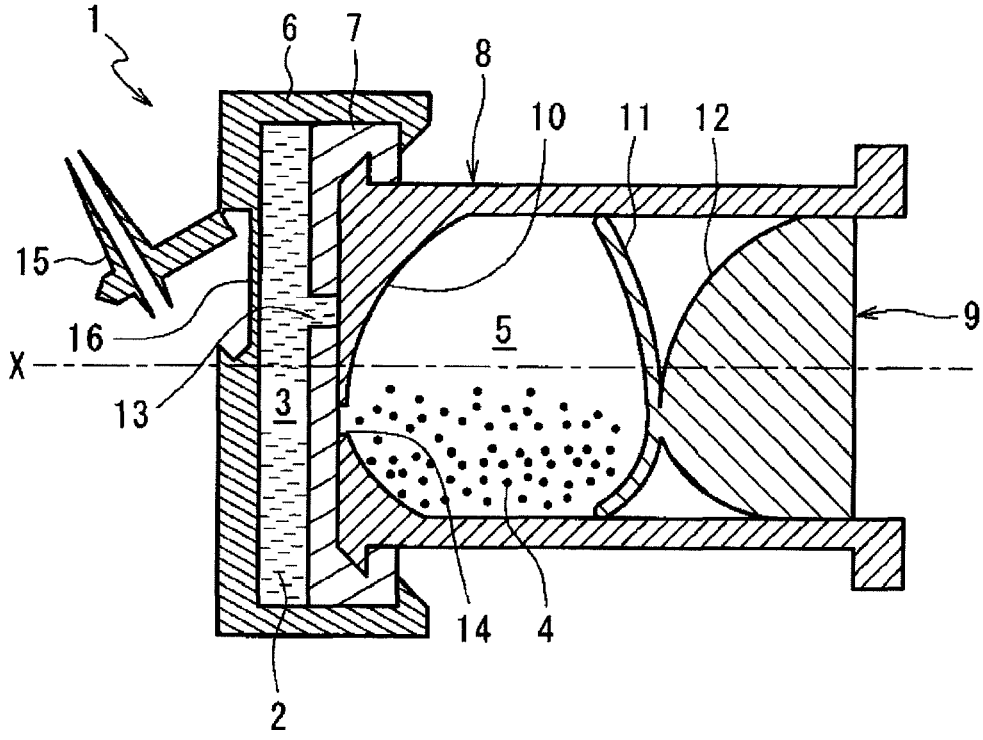
FIG. 1 is a sectional view of a storage state of a chemicals mixing container according to a first embodiment of the present invention.

1 chemicals mixing container
2 liquid material (chemical)
3 first internal space
4 powder material (chemical)
5 second internal space
6 first cylinder
7 first piston
8 second cylinder
9 second piston
10 end wall
13 communicating hole
14 communicating hole
17 mixture
18 end wall
19 end wall
21 protrusion
22 guide groove
23 protrusion
24 guide groove
25 protrusion
26 guide groove

DETAILED DESCRIPTION OF THE INVENTION

Hereinbelow, embodiments of the present invention will be described in detail with reference to the accompanying drawings.

FIG. 1 shows a chemicals mixing container 1 according to a first embodiment of the invention. The chemicals mixing container 1 isolates and stores therein two kinds of chemicals, particularly a powder material and a liquid material, for generating amalgam or other dental materials, bone cement or other medical materials and the like. At a time of use, the chemicals mixing container 1 can be used to mix the two kinds of chemicals and discharge (extrude) a desired mixture (or reaction product) as required.

The chemicals mixing container 1 has a first internal space 3 for containing a liquid material 2, and a second internal space 5 for containing a powder material 4. The first internal space 3 is defined by a generally cylindrical-shaped first cylinder 6 and a generally disc-shaped first piston 7 fitted in the first cylinder 6. The second internal space 5 is defined by a generally cylindrical-shaped second cylinder 8 connected to an outer side of the first piston 7 so as to be rotationally slidable thereon, and a second piston 9 fitted in the second cylinder 8.

The cylindrical portion of the second cylinder 8 has an end wall 10 which includes a flat outer wall surface serving as a sliding surface for the first piston 7, and an inner wall surface that is curved to make the second internal space 5 swollen toward the first piston 7. The second piston 9 is composed of an elastically-deformable, thin plate-shaped elastic partition wall portion 11, and an auxiliary member portion 12 connected to an outer side of the elastic partition wall portion 11. An outer peripheral portion of the elastic partition wall portion 11 is in air-tight sliding contact with the inner wall surface of the cylindrical portion of the second cylinder 8 over its entire periphery and is curved so as to make the second internal space 5 swollen toward a counter side of the first piston 7. The auxiliary member portion 12, which has a convex shape conforming to the shape of the inner wall surface of the end wall 10 of the second cylinder 8, is formed integrally with the elastic partition wall portion 11.

In sliding surfaces of the first piston 7 and the second cylinder 8, communicating holes 13, 14 are formed at positions, respectively, which are eccentric by an equal distance from a rotation axis X of the rotational sliding surfaces. In market distribution of the chemicals mixing container 1 and in its storage at medical offices, rotational positions of the first piston 7 and the second cylinder 8 are so determined that the communicating holes 13 and 14 are positionally different from each other as shown in FIG. 1, thereby making the first internal space 3 and the second internal space 5 isolated from each other.

Also, the first cylinder 6 has, outside a wall of one end face thereof, a nozzle 15 formed in integrated connection. The nozzle 15, which swings against the first cylinder 6, is fittable to a fitting recess 16 provided outside the end face of the first cylinder 6. When the nozzle 15 is fitted in the fitting recess 16, a protrusion of the nozzle 15 extends through a small-thickness bottom portion of the fitting recess 16 so that the first internal space 3 is opened to the outside via the nozzle 15.

Figure 2:
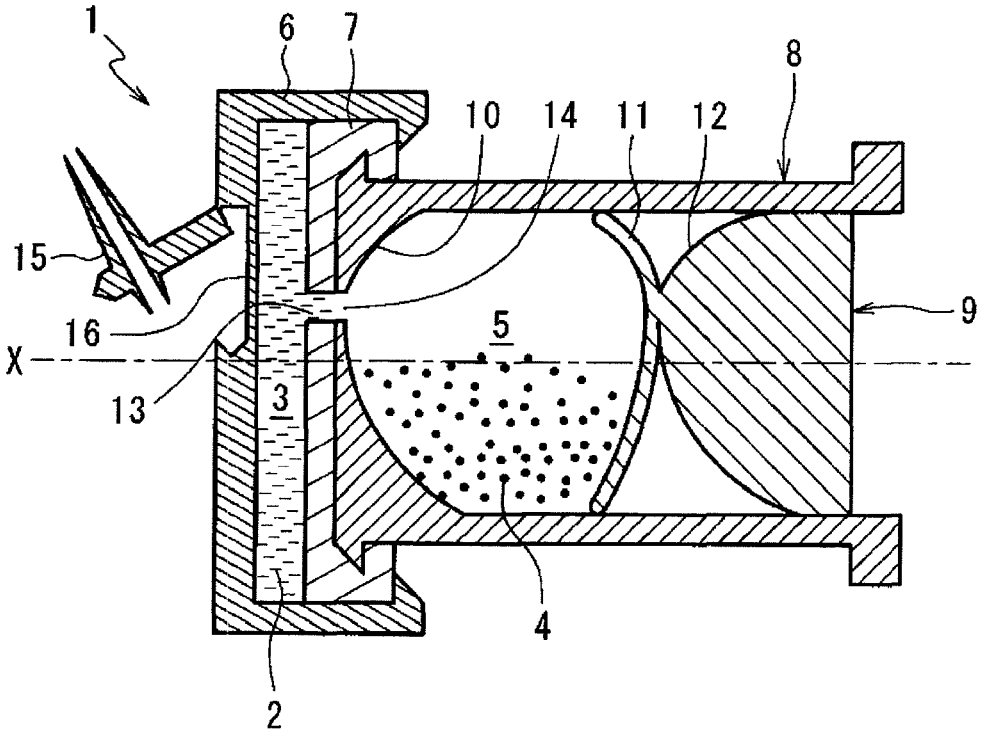
FIG. 2 is a sectional view showing a first step for use of the chemicals mixing container of FIG. 1.

For use of the chemicals mixing container 1, first, as shown in FIG. 2, the second cylinder 8 is rotated relative to the first piston 7 so that the communicating hole 13 of the first piston 7 and the communicating hole 14 of the second cylinder 8 communicate with each other.

Figure 3:
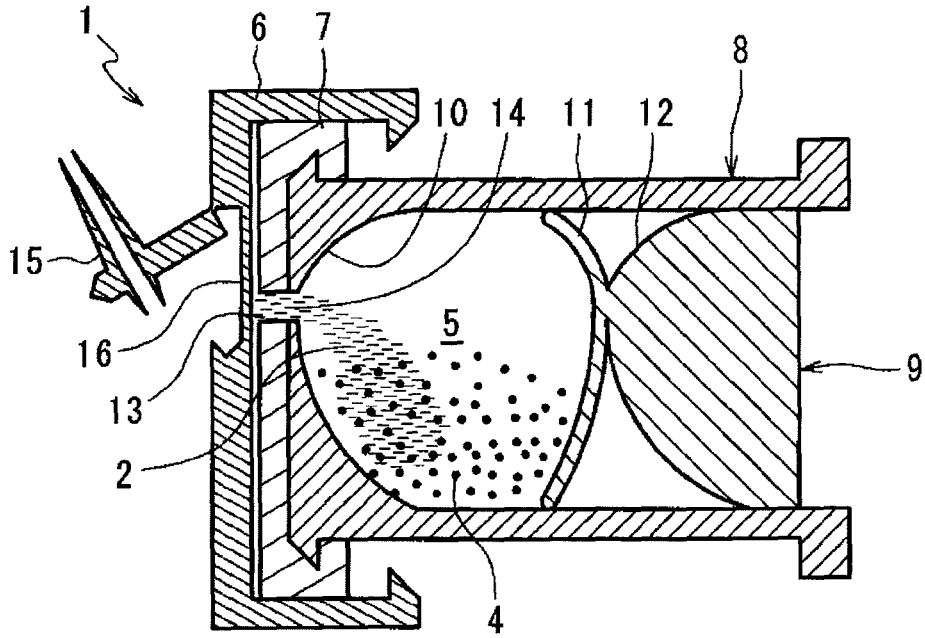
FIG. 3 is a sectional view showing a second step for use of the chemicals mixing container of FIG. 1.

Then, as shown in FIG. 3, the first piston 7 along with the second cylinder 8 and the second piston 9 is pushed deep into the first cylinder 6 to compress the first internal space 3. As a result, the liquid material 2 contained in the first internal space 3 flows into the second internal space 5 via the communicating holes 13, 14.

After the liquid material 2 is injected into the second internal space 5, the chemicals mixing container 1 is well shaken to mix the liquid material 2 and the powder material 4 together. In this case, the end wall 10 of the second cylinder 8 and the elastic partition wall portion 11 of the second piston 9 are so shaped as to provide larger interior angles of corners of the second internal space 5, so that the liquid material 2 and the powder material 4 are less likely to be accumulated. This facilitates an unevenness-free, uniform mixing of the liquid material 2 and the powder material 4.

Figure 4:
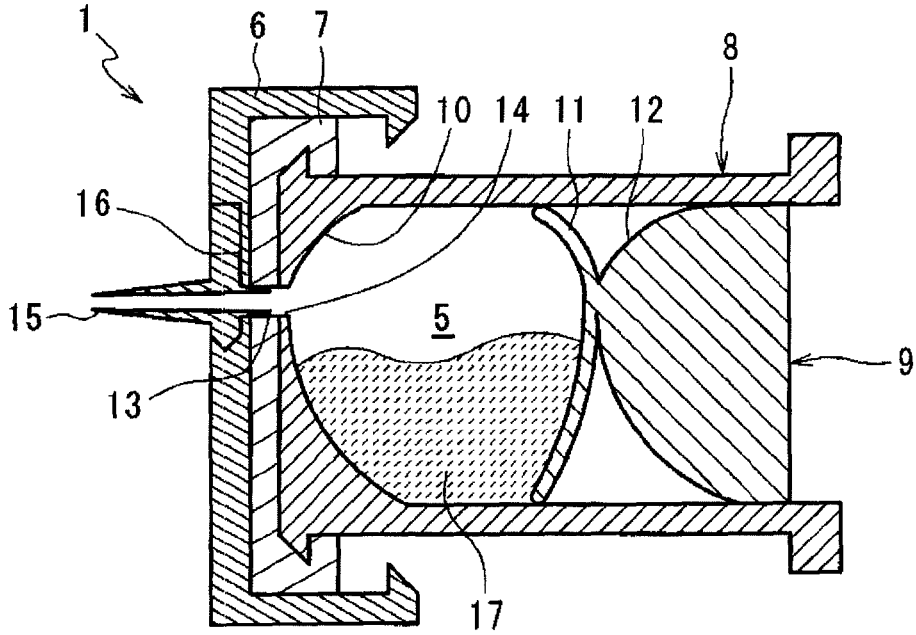
FIG. 4 is a sectional view showing a third step for use of the chemicals mixing container of FIG. 1.
Figure 5:
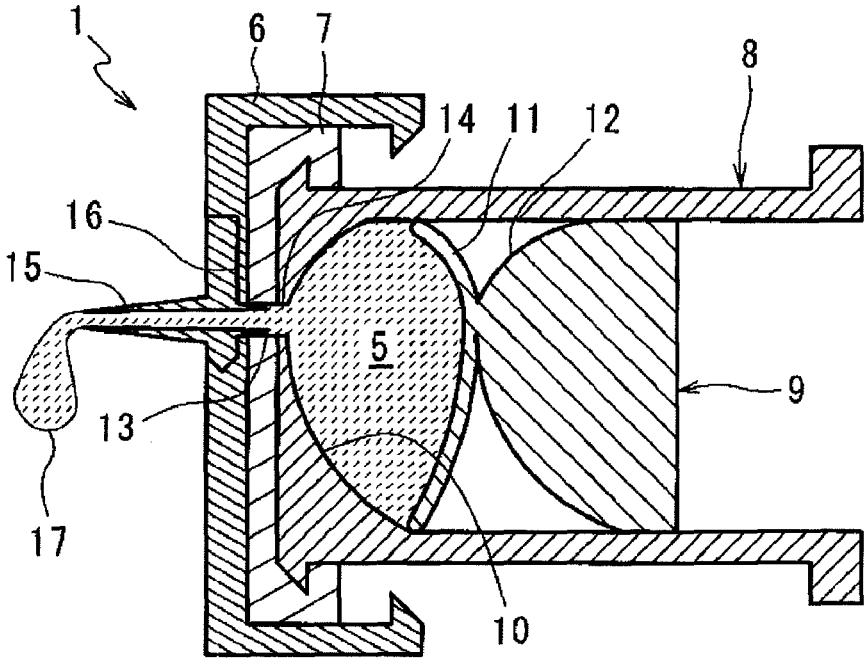
FIG. 5 is a sectional view showing a fourth step for use of the chemicals mixing container of FIG. 1.

Once the liquid material 2 and the powder material 4 have been sufficiently mixed, the nozzle 15 is set in the fitting portion 16 so as to form an ejection path for a mixture (or reaction product) 17 of the liquid material 2 and the powder material 4 as shown in FIG. 4. Then, as shown in FIG. 5, pushing in the second piston 9 allows the mixture (or reaction product) 17 within the second internal space 5 to be extruded out through the nozzle 15.

The inner wall surface of the end wall 10 of the second cylinder 8 and the elastic partition wall portion 11 of the second piston 9 are curved in mutually counter directions. Therefore, as shown in FIG. 5, the outer peripheral portion of the elastic partition wall portion 11 comes into contact with the inner wall surface of the end wall 10 before the second internal space 5 is completely compressed.

Figure 6:
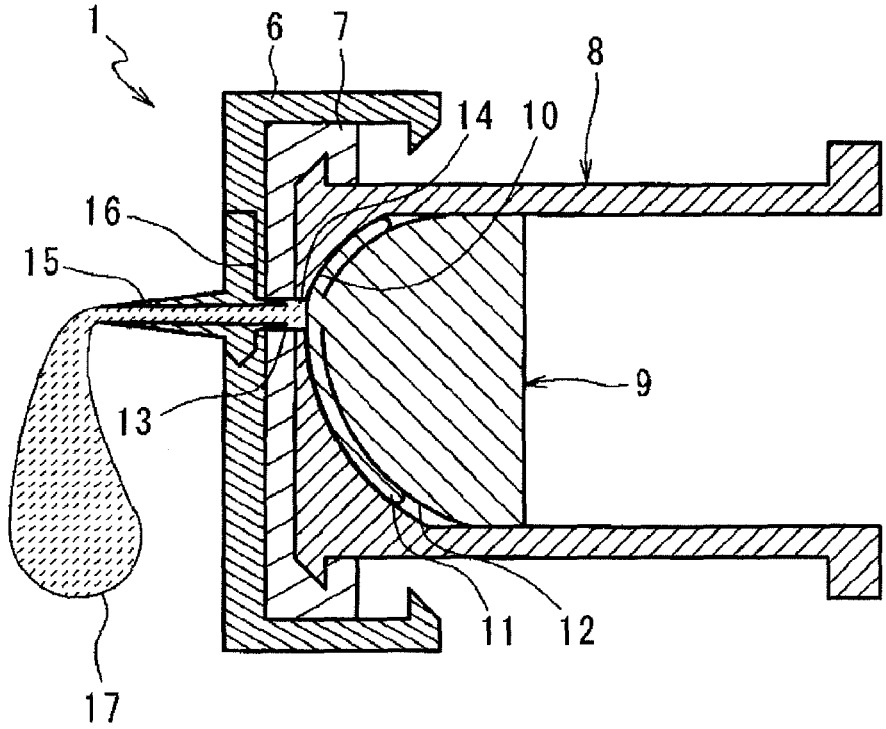
FIG. 6 is a sectional view showing a fifth step for use of the chemicals mixing container of FIG. 1.

However, since the elastic partition wall portion is elastically deformable, further pushing in of the second piston 9 allows the elastic partition wall portion 11 to be warped in a reverse direction until the elastic partition wall portion 11 comes into contact with the auxiliary member portion 12 as shown in FIG. 6. Since the auxiliary member portion 12 has a shape that conforms to the inner wall surface of the end wall 10, the second piston 9 can make the second internal space 5 essentially zero in capacity as shown in the figure. That is, the mixture 17 resulting from mixing together the liquid material 2 and the powder material 4 is discharged via the nozzle 15 according to a pushed-in extent of the second piston 9.

As described above, the chemicals mixing container is able to store the two kinds of chemicals, the liquid material 2 and the powder material 4, dividedly and in isolation in the first internal space 3 and the second internal space 5, respectively, and to reliably mix together the liquid material 2 and the powder material 4, as required, simply by rotating the second cylinder 8 relative to the first piston 7 so that the first internal space 3 and the second internal space 5 are communicated with each other easily and reliably.

Figure 7:
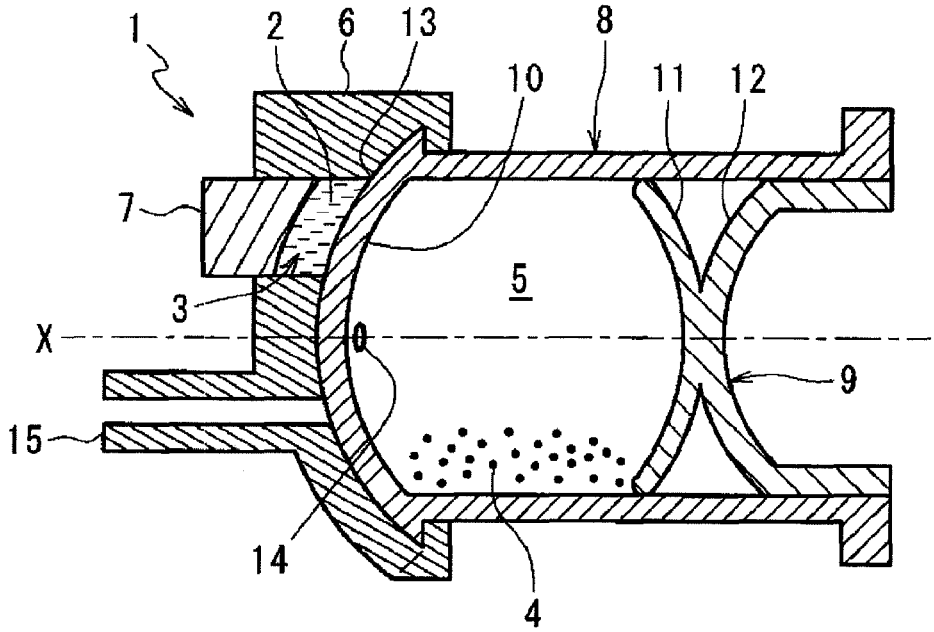
FIG. 7 is a sectional view of a storage state of a chemicals mixing container according to a second embodiment of the invention.

Further, FIG. 7 shows a chemicals mixing container 1 according to a second embodiment of the invention. It is noted that in the following description, the same component members as those described above are designated by the same reference signs and their description is omitted.

In the chemicals mixing container 1, the second cylinder 8 is connected to the first cylinder 6 so as to be rotationally slidable on a spherical sliding surface. In this embodiment, the first internal space 3 is smaller in diameter than the second internal space 5 and is eccentric relative to the rotation axis X of the first cylinder 6 and the second cylinder 8. In the first cylinder 6, the first internal space 3 is fully opened to the second cylinder 8, meaning that an aperture of the communicating hole 13 is equal to an inner diameter of the first cylinder 6. In this embodiment, the nozzle 15 is formed so as to be preliminarily opened to the sliding surface of the first cylinder 6 against the second cylinder 8.

Figure 8:
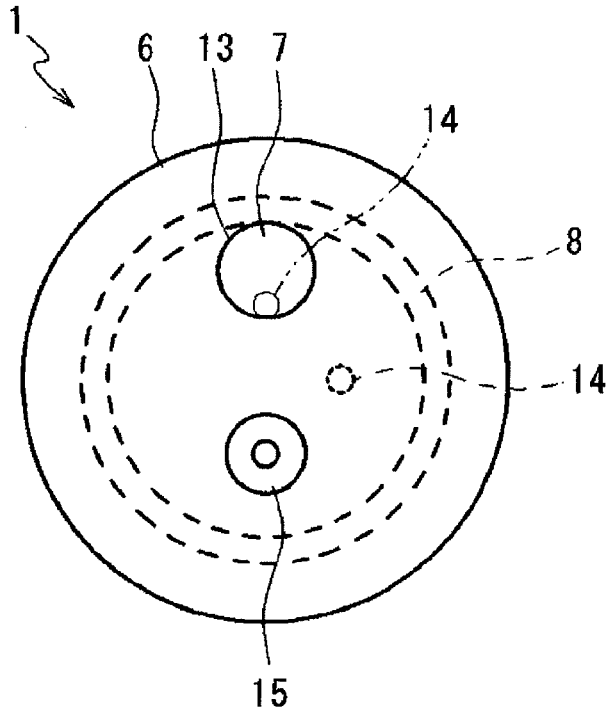
FIG. 8 is a front view of the chemicals mixing container of FIG. 7.

FIG. 8 shows a state of the chemicals mixing container 1 of this embodiment as viewed from its front on the nozzle 15 side. As shown in the figure, the communicating hole 14 of the second cylinder 8 can be communicated with either the communicating hole 13 or the nozzle 15 depending on a rotational position of the second cylinder 8 relative to the first cylinder 6.

Figure 9:
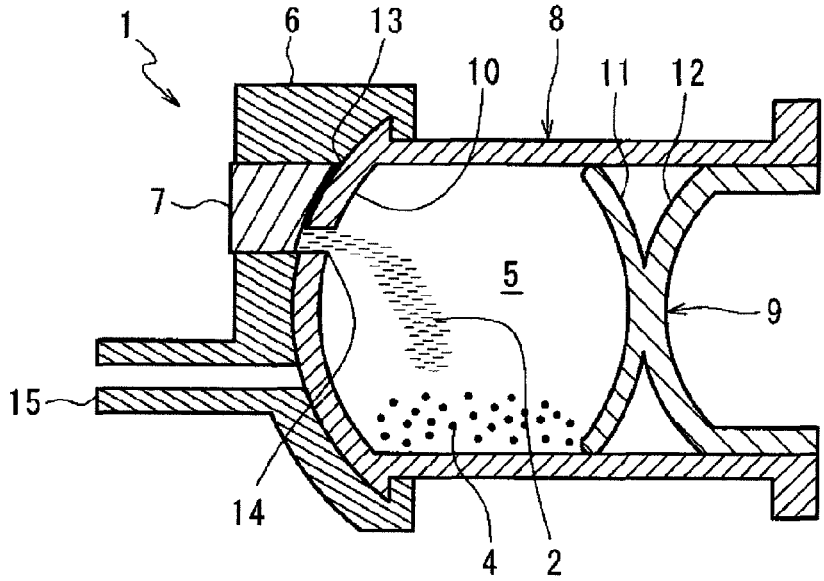
FIG. 9 is a sectional view showing a step for use of the chemicals mixing container of FIG. 7.

By this arrangement, also in the chemicals mixing container 1 of this embodiment, by rotating the second cylinder 8 relative to the first cylinder 6 so that the communicating hole 14 is communicated with the communicating hole 13, the first piston 7 can be pushed into the first cylinder 6 as shown in FIG. 9 so that the liquid material 2 is injected into the second internal space 5, thus making it possible to reliably mix together the two kinds of chemicals, the liquid material 2 and the powder material 4.

Further, rotating the second cylinder 8 relative to the first cylinder 6 so that the communicating hole 14 is communicated with the nozzle 15 allows the mixture 17 of the liquid material 2 and the powder material 4 to be discharged in its generally full amount through the nozzle 15 according to the pushed-in extent of the second piston 9.

Figure 10:
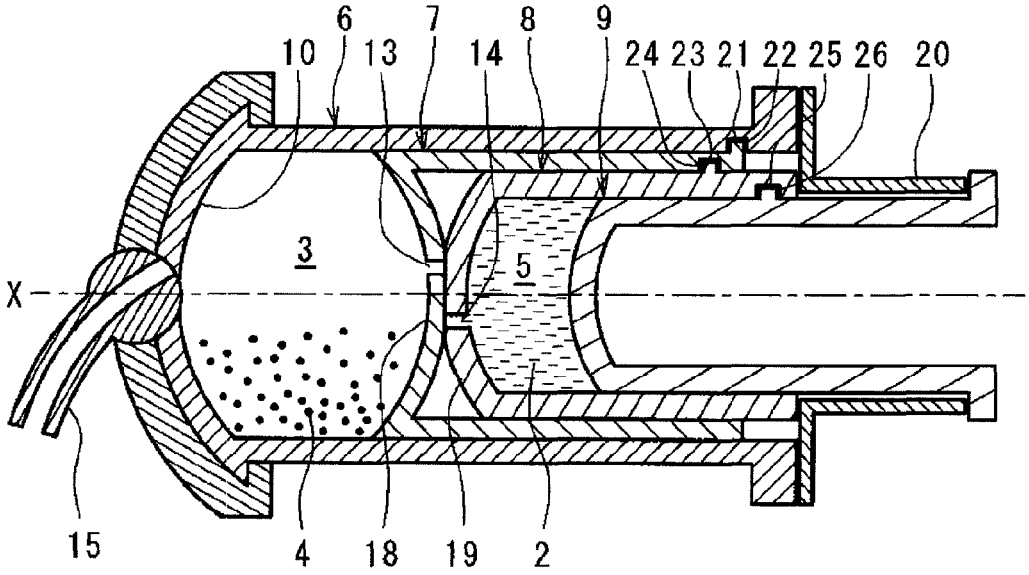
FIG. 10 is a sectional view of a storage state of a chemicals mixing container according to a third embodiment of the invention.

Further, FIG. 10 shows a chemicals mixing container 1 according to a third embodiment of the invention. In this embodiment, the first piston 7 is formed from an elastically deformable material into a cylindrical shape having an end wall 18 which makes sliding contact with the inner wall surface of the cylindrical portion of the first cylinder 6 to define the first internal space 3. The second cylinder 8 is formed into a cylindrical shape having an end wall 19 which is fitted into the cylindrical portion of the first piston 7 and which makes sliding contact with the end wall 18. The end wall 19 of the second cylinder 8 has a convex external shape conforming to the shape of the inner wall surface of the end wall 10 of the first cylinder 6.

In sliding surfaces of the end wall 18 of the first piston 7 and the end wall 19 of the second cylinder 8, communicating holes 13, 14 are formed at positions, respectively, which are eccentric by an equal distance from the rotation axis X.

Also, in the chemicals mixing container 1 of this embodiment, a mis-operation preventing collar 20 for preventing mis-operations is fitted between an end portion of the first cylinder 6 and a flange of an end portion of the second piston 9. The mis-operation preventing collar 20 is removable for use of the chemicals mixing container 1.

The nozzle 15 of this embodiment has a spherical body with a flow-through passage formed therein. The nozzle is held so as to be rotatable relative to the opening of the first cylinder 6 and serves as a ball valve which allows the flow-through passage to communicate with the opening or seals the opening by the spherical surface.

In this embodiment, the powder material 4 is contained in the first internal space 3 of the first cylinder 6, and the liquid material 2 is contained in the second internal space 5 of the second cylinder 8.

Also, in an inner wall surface of the cylindrical portion of the first cylinder 6 is formed a guide groove 22 which receives a protrusion 21 provided at a portion of the outer periphery of the cylindrical portion of the first piston 7 so as to restrict a rotational position of the first piston 7 relative to the first cylinder 6. Similarly, in the inner wall surface of the cylindrical portion of the first piston 7 is formed a guide groove 24 which receives a protrusion 23 provided at a portion of the outer periphery of the cylindrical portion of the second cylinder 8. In the inner wall surface of the cylindrical portion of the second cylinder 8 is formed a guide groove 26 which receives a protrusion 25 provided at a portion of the outer periphery of the cylindrical portion of the second piston 9.

Figure 11:
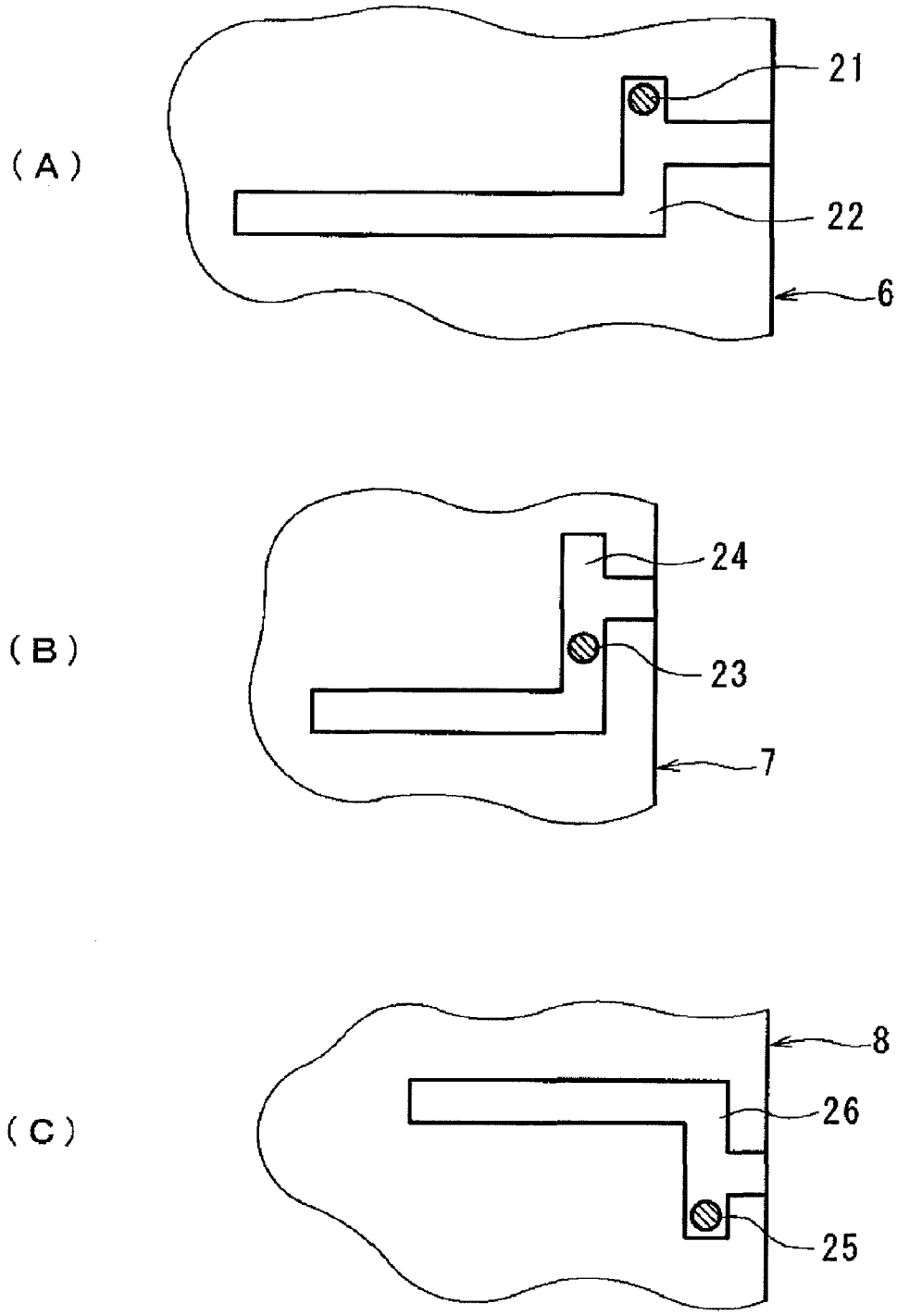
FIG. 11 is a developed view of a rotation restricting structure of the chemicals mixing container of FIG. 10.

These protrusions 21, 23, 25 and the guide grooves 22, 24, 26 make up a rotation restricting structure for ensuring proper operating procedure for the chemicals mixing container 1. FIG. 11 shows a developed view of the rotation restricting structure.

Engagement between the protrusion 21 and the guide groove 22 restricts a rotational range of the first piston 7 relative to the first cylinder 6, making it possible to push the first piston 7 inward of the first cylinder 6 only while the first piston 7 is in a specified rotational position. Engagement between the protrusion 23 and the guide groove 24 restricts a rotational range of the second cylinder 8 relative to the first piston 7, making it possible to push the second cylinder 8 inward of the first piston 7 only while the second cylinder 8 is in a specified rotational position. Engagement between the protrusion 25 and the guide groove 26 restricts a rotational range of the second piston 9 relative to the second cylinder 8, making it possible to push the second piston 9 inward of the second cylinder 8 only while the second piston 9 is in a specified rotational position.

FIG. 11 shows a rotation restricting structure of the chemicals mixing container 1 in a storage state before use. In this state, since the protrusions 21, 23, 25 are restricted in their axial movement by the guide grooves 22, 24, 26, respectively, the second piston 9 cannot be pushed into the first cylinder 6 even if the mis-operation preventing collar 20 is removed.

For use of the chemicals mixing container 1, first, a user rotates the second piston 9 counterclockwise relative to the first cylinder 6. Then, the protrusion 25 of the second piston 9 is moved to a left end (upper end in FIG. 11(C)) of the guide groove 26 of the second cylinder 8. Further, the protrusion 25 makes the guide groove 26 rotated, causing the second cylinder 8 to be rotated counterclockwise relative to the first piston 7. When this rotation has caused the protrusion 23 to reach a left end (upper end in FIG. 11(B)) of the guide groove 24, that is, has caused the second cylinder 8 to be positioned at a left end of the rotatable range relative to the first piston 7, the communicating hole 14 of the second cylinder 8 is communicated with the communicating hole 13 of the first piston 7. At this point, since the protrusion 21 of the first piston 7 is at a left end (upper end in FIG. 11(A)) of the guide groove 22 of the first cylinder 6, the second piston 9 and the second cylinder 8 cannot be rotated counterclockwise any more.

Once the second piston 9 has been rotated counterclockwise as much as possible, the user is enabled to push the second piston 9 into the first cylinder 6. In this state, the protrusion 21 of the first piston 7 and the protrusion 23 of the second cylinder 8 are at the left ends of the guide groove 22 of the first cylinder 6 and the guide groove 24 of the first piston 7, respectively, being prohibited from moving in the axial direction. As a result of this, only the second piston 9 is enabled to be pushed in within the second cylinder 8.

As described above, the chemicals mixing container ensures a proper procedure of, after making the communicating hole 14 of the second cylinder 8 communicate with the communicating hole 13 of the first piston 7, pushing the second piston 9 into the second cylinder 8 to compress the second internal space 5 so that the liquid material 2 is injected into the first internal space 3.

After this chemicals mixing container 1 is shaken enough to mix the liquid material 2 and the powder material 4 together with the mixture 17 generated, the user rotates the second piston 9, this time clockwise as much as possible, so that the first piston 7 is pushed into the first cylinder 6, thus making it possible to extrude the mixture 17 out.

In more detail, since the protrusion 25 has been moved to a depth of the guide groove 26 as a result of pushing the second piston 9 into the second cylinder 8, the second piston 9 cannot be rotated relative to the second cylinder 8. The second cylinder 8 is rotated inside the first piston 7 to make the protrusion 23 move to a right end (lower end in FIG. 11(B)) of the guide groove 24. As a result of this rotation, the communicating hole 13 of the first piston 7 and the communicating hole 14 of the second cylinder 8 are separated from each other. The first piston 7 is rotated inside the first cylinder 6 to make the protrusion 21 move to the right end (lower end in FIG. 11(A)) of the guide groove 22. As a result, the protrusion 21 and the protrusion 23 are allowed to move deeper (leftward in FIG. 11) in axial portions of the guide groove 22 and the guide groove 24.

An outer peripheral portion of the end wall 18 of the first piston 7, when coming into contact with the inner wall surface of the end wall of the first cylinder 6, is elastically deformed by the end wall 19 of the second cylinder 8 to compress the remaining space of the first internal space 3, thus allowing the mixture 17 to be completely discharged.

The invention claimed is:

1. A chemicals mixing container comprising:

a first cylinder;

a first piston which is fitted in the first cylinder to define a first internal space;

a second cylinder which is connected to the first piston so as to be rotationally slidable thereon about a rotation axis; and a second piston which is fitted in the second cylinder to define a second internal space, wherein the second cylinder and the first piston to which the second cylinder is connected have communicating holes formed in their mutual sliding surfaces at positions, respectively, eccentric relative to the rotation axis, and the first internal space and the second internal space are communicated with or isolated from each other depending on a rotational position of the second cylinder relative to the first piston to which the second cylinder is connected.

2. The chemicals mixing container as claimed in claim 1, wherein the first cylinder and the second cylinder are formed into generally cylindrical and concentric shapes.

3. The chemicals mixing container as claimed in claim 1, further comprising a rotation restricting structure for restricting a relative rotational range of the second cylinder and the first piston to which the second cylinder is connected so that their respective communicating holes are communicated with each other at an end of the rotational range.

4. The chemicals mixing container as claimed in claim 1, wherein the first cylinder is formed into a cylindrical shape having an end wall, the first piston is formed into a cylindrical shape having an end wall which defines the first internal space in the first cylinder, the second cylinder is formed into a cylindrical shape having an end wall which is fitted inside the first piston and which slides in contact with the end wall of the first piston, and the communicating holes are formed in the end wall of the first piston and the end wall of the second cylinder, respectively.

5. The chemicals mixing container as claimed in claim 2, further comprising a rotation restricting structure for restricting a relative rotational range of the second cylinder and the first piston to which the second cylinder is connected so that their respective communicating holes are communicated with each other at an end of the rotational range.

6. The chemicals mixing container as claimed in claim 1, wherein the second piston comprises an elastic partition wall portion connected to an auxiliary member portion, and a leading surface of the auxiliary member portion being shaped so as to conform to an inner end surface of the second cylinder.

7. The chemicals mixing container as claimed in claim 1, further comprising a nozzle connected to the first cylinder, wherein the first cylinder includes a fitting recess, formed in an outside surface of the first cylinder, for receiving the nozzle to establish communication with first internal space.

8. The chemicals mixing container as claimed in claim 7, wherein the nozzle includes a protrusion for rupturing a wall in the fitting recess.

9. A chemicals mixing container comprising:

a first cylinder having a communicating hole formed therein;

a first piston fitted in the first cylinder to define a first internal space;

a second cylinder connected to the first cylinder so as to be rotationally slidable thereon, the second cylinder having a communicating hole formed therein; and a second piston fitted in the second cylinder to define a second internal space, wherein the communicating holes of the second cylinder and the first cylinder are formed in mutual sliding surfaces at positions, respectively, that are eccentric relative to a rotation axis, and wherein the first internal space and the second internal space are communicated with or isolated from each other depending on a rotational position of the second cylinder relative to the first cylinder.

10. The chemicals mixing container as claimed in claim 9, wherein the first cylinder and the second cylinder are formed into generally cylindrical and concentric shapes.

11. The chemicals mixing container as claimed in claim 9, further comprising a rotation restricting structure for restricting a relative rotational range of the second cylinder and the first cylinder so that their respective communicating holes are communicated with each other at an end of the rotational range.

12. The chemicals mixing container as claimed in claim 9, wherein:

the first cylinder is formed into a cylindrical shape having an end wall, the first piston is formed into a cylindrical shape having an end wall which defines the first internal space in the end wall of the first cylinder, the second cylinder is formed into a cylindrical shape having an end wall which is fitted inside the first piston and which slides in contact with the end wall of the first piston, and the communicating holes are formed in the end wall of the first piston and the end wall of the second cylinder, respectively.

13. The chemicals mixing container as claimed in claim 10, further comprising a rotation restricting structure for restricting a relative rotational range of the second cylinder and the first cylinder so that their respective communicating holes are communicated with each other at an end of the rotational range.

14. The chemicals mixing container as claimed in claim 9, wherein the second piston comprises an elastic partition wall portion connected to an auxiliary member portion, and a leading surface of the auxiliary member portion being shaped so as to conform to an inner end surface of the second cylinder.

15. The chemicals mixing container as claimed in claim 9, further comprising a nozzle integrally formed with the first cylinder, the communicating hole in the second cylinder aligning with the nozzle depending upon the relative rotational position of the first cylinder and the second cylinder.

* * * * *